United States Patent [19]

DiNicolantonio et al.

[11] Patent Number: 4,499,055

[45] Date of Patent: Feb. 12, 1985

[54] FURNACE HAVING BENT/SINGLE-PASS TUBES

[75] Inventors: Arthur R. DiNicolantonio, Whippany; Victor K. Wei, Florham Park, both of N.J.

[73] Assignee: Exxon Research & Engineering Co., Florham Park, N.J.

[21] Appl. No.: 301,763

[22] Filed: Sep. 14, 1981

[51] Int. Cl.[3] ..... C01D 1/32

[52] U.S. Cl. ..... 422/197; 422/204; 165/81; 165/163

[58] Field of Search ..... 165/81, 82, 163; 422/196, 173, 197, 198, 200, 201, 204, 307; 585/415

[56] References Cited

U.S. PATENT DOCUMENTS

| | | | |
|---|---|---|---|
| 1,788,386 | 1/1931 | Ehrhart | 165/81 |
| 1,894,279 | 1/1933 | Meyer | 165/82 |
| 2,323,498 | 7/1943 | Thompson | 122/356 |
| 2,479,544 | 8/1949 | Schauble | 196/116 |
| 2,587,720 | 3/1952 | Fritzberg | 165/163 |
| 2,917,564 | 12/1959 | Pollock | 585/636 |
| 3,195,989 | 7/1965 | Pyzel . | |
| 3,230,052 | 1/1966 | Lee et al. . | |
| 3,257,172 | 6/1966 | Kao et al. | 422/197 |
| 3,258,067 | 6/1966 | Fleur | 165/81 |
| 3,407,789 | 10/1968 | Hallee et al. . | |
| 3,450,506 | 6/1969 | Guerrieri . | |
| 3,495,556 | 2/1970 | Steever et al. . | |
| 3,583,476 | 6/1971 | Woebcke et al. . | |
| 3,607,130 | 9/1971 | Worley et al. . | |
| 3,671,198 | 6/1972 | Wallace | 422/197 |
| 3,820,955 | 6/1974 | Woebke | 422/197 |

FOREIGN PATENT DOCUMENTS

| | | | |
|---|---|---|---|
| 825214 | 5/1975 | Belgium . | |
| 570115 | 6/1945 | United Kingdom | 165/163 |

*Primary Examiner*—Bernard Nozick

*Attorney, Agent, or Firm*—S. H. Markowitz

[57] ABSTRACT

An improved single-pass, radiant tube for steam cracking hydrocarbons is capable of self-absorbing differential thermal expansion during furnace operation by virtue of tube sections being offset.

41 Claims, 9 Drawing Figures

FURNACE HAVING BENT/SINGLE-PASS TUBES

INTRODUCTION

The present invention relates to a fired heater for heating process fluids, e.g., process heaters and heated tubular reactors both with and without catalyst. More specifically, it relates to a fired heater of the type which comprises at least one radiant section in which process fluid flowing therein through conduit means is indirectly heated, preferably, by radiant energy provided by burners. Methods and apparatus used in accordance with the present invention are particularly well suited and advantageous for pyrolysis of normally liquid or normally gaseous aromatic and/or aliphatic hydrocarbon feedstocks such as ethane, propane, naphtha or gas oil to produce less saturated products such as acetylene, ethylene, propylene, butadiene, etc. Accordingly, the present invention will be described and explained in the context of hydrocarbon pyrolysis, particularly steam cracking to produce ethylene.

BACKGROUND OF THE INVENTION

Steam cracking of hydrocarbons has typically been effected by supplying the feedstock in vaporized or substantially vaporized form, in admixture with substantial amounts of steam, to suitable coils in a cracking furnace. It is conventional to pass the reaction mixture through a number of parallel coils or tubes which pass through a convection section of the cracking furnace wherein hot combustion gases raise the temperature of the reaction mixture. Each coil or tube then passes through a radiant section of the cracking furnace wherein a mulitplicity of burners supply the heat necessary to bring the reactants to the desired reaction temperature and effect the desired reaction.

Of primary concern in all steam cracking processes is the formation of coke. When hydrocarbon feedstocks are subjected to the heating conditions prevalent in a steam cracking furnace, coke deposits tend to form on the inner walls of the tubular members forming the cracking coils. Not only do such coke deposits interfere with heat flow through the tube walls into the stream of reactants, but also with the flow of the reaction mixture due to tube blockage.

At one time, it was thought that a thin film of hydrocarbons sliding along the inside walls of the reaction tubes was primarily responsible for coke formation. According to this theory, a big part of the temperature drop between the tube wall and the reaction temperature in the bulk of the hydrocarbon process fluid takes place across this film. Accordingly, an increase in heat flux, meaning a rise in tube-wall temperature, called for a corresponding increase in film temperature to points high enough to cause the film to form coke. Thus, coke was thought to be prevented by using lower tube-wall temperatures, meaning less heat flux into the reaction mixture and longer residence times for the reactions.

In order to achieve high furnance capacity, the reaction tubes were relatively large, e.g., three to five inch inside diameters. However, a relatively long, fired reaction tube, e.g., 150 to 400 feet, was required to heat the fluid mass within these large tubes to the required temperature, and furnaces, accordingly, required coiled or serpentine tubes to fit within the confines of a reasonably sized radiant section. The problems of coke formation, as well as, pressure drop were increased by the multiple turns of these coiled tubes. Also, maintenance and construction costs for such tubes were relatively high as compared, for example, with straight tubes.

In a 1965 article, entitled "ETHYLENE", which appeared in the November 13 issue of CHEMICAL WEEK, some basic discoveries that revolutionized steam cracking furnace design are disclosed. As a result of these discoveries, new design parameters evolved that are still in use today.

As disclosed in the article, researchers discovered that secondary reactions in the reacting gases, not in the film, are responsible for tube-wall coke. However, shorter residence time with more heat favors primary olefin-forming reactions, not these secondary coke-causing reactions. Accordingly, higher heat flux and higher tube-wall temperatures emerged as the answer.

The article also indicates, however, that reduced residence time is not a simple matter of speedup (of flow of process gas through the tubes), as the heat consumed by cracking hydrocarbons is fairly constant—about 5,100 BTU/lb. of ethylene. Consequently, it suggests that a shorter residence time requires that heat must be put into the hydrocarbons faster. Two feasible ways suggested for expanding this heat input are by altering the mechanical design of the tubes so they have greater external surface per internal volume and increasing the rate of heat flux through the tube walls. The ratio of external tube surface to internal volume, it is disclosed, can be increased by reducing tube diameter. The rate of heat flux through the tube walls is accomplished by heating the tubes to higher temperatures.

Thus, the optimum way of improving selectivity to ethylene was found to be by reducing coil volume while maintaining the heat transfer surface area. This was accomplished by replacing large diameter, serpentine coils with a multiplicity of smaller diameter tubes having a greater surface-to-volume ratio than the large diameter tubes. The coking and pressure drop problems mentioned above were effectively overcome by using once-through (single-pass) tubes in parallel such that the process fluid flowed in a once-through fashion through the radiant box, either from arch to floor or floor to arch. The tubes typically have inside diameters up to about 2 inches, generally from about 1 to 2 inches. Tube lengths can be about 15 to 50 feet, with about 20–40 feet being more likely .

Accordingly, it is most desirable to utilize small diameter (less than about 2 inch inside diameters), once-through reaction tubes with short residence times (about 0.05 to 0.15 seconds) and high outlet temperatures (heated to about 1450° F. to 1700° F.), such as disclosed in U.S. Pat. No. 3,671,198 to Wallace. But while this reference typifies some of the key advantages related to state-of-the-art furnace technology, it also typifies some of the serious disadvantages related to the same.

During operation of the furnace, the tremendous amount of heat generated in the radiant section by the burners will cause the tubes to expand, that is, experience thermal growth. Due to variations in process fluid flow to each tube, uneven coking rates, and non-uniform heat distribution thereto from the burners, the tubes will grow at different rates. However, since the coil is now formed from a multiplicity of parallel, small diameter tubes fed from a common inlet manifold and the reaction effluent from the radiant section is either collected in a common outlet manifold or routed directly to a transfer line exchanger, the tubes are constrained. That is, there is no provision to absorb the differential thermal growth amongst the individual tubes. The thermal stresses caused by differential thermal growth of the individual tubes can be excessive and can easily rupture welds and/or severely distort the coil.

As shown in Wallace, this differential thermal growth is typically absorbed by providing each tube with a flexible support comprised of support cables strung over pulleys and held by counterweights. Each flexible support must absorb the entire amount of thermal growth experienced by its corresponding reaction tube, typically as much as about 6 to 9 inches, and is also used to support the tube in its vertical position. This flexible support system also makes use of flexible-tube interconnections between the inlet manifold and the reaction tubes to absorb differential thermal growth thereof as shown, for example, in FIG. 2 of Wallace. This flexible-tube interconnection typically takes the form of a long (up to about 10 feet) flexible loop, known as a "pigtail", of small diameter (about 1 inch) located externally to the radiant section. The pigtail has a high pressure drop and, therefore, cannot be used at the outlets of the reaction tubes as one of the objectives in operating the furnace is to reduce pressure drop.

When used at the inlets to the reaction tubes, these pigtails can interfere significantly with critical burner arrangements. One of the major constraints limiting the reduction in residence time and pressure drop is the allowable tube metal temperature. In order to keep tube metal temperatures within acceptable ranges for current day metallurgy, it is desirable to arrange the flow of reaction fluid so that the lowest process fluid temperatures occur where the burner heat release is highest. This requires locating burners at the inlet of the coil, i.e., for process fluid flow from floor to arch (ceiling), burners are located at the floor and for process fluid flow from arch to floor, at the arch. It is, thus, undesirable to locate the pigtails at the coil inlet because they interfere with access to the furnace for maintenance or process change purposes. For example, it is periodically necessary to pull burners for routine maintenance or replacement. Also for example, it may be desirable to modify the burners so as to provide for air preheat thereto. With the pigtails in the way, these tasks become increasingly difficult and burdensome.

Because the pigtails are made of flexible material incapable of structurally supporting the radiant tubes, separate support for the tubes is required, adding to the overall expense for the furnace. Also, the use of long, small diameter tubing at temperatures at which small amounts of coking occurs increases the chances for experiencing coking problems. Should such problems occur, the pigtails can be so difficult to clean-out that they most likely will require cutting out in order to remove the coke from the furnace system. Furthermore, the pigtails are made of material that is highly susceptible to cracking from the extreme heat generated by the steam cracking process, potentially requiring frequent replacement.

DESCRIPTION OF THE INVENTION

According to the present invention, a fired heater for heating process fluid comprises at least one radiant section having at least one coil (row) of single-pass, radiant tubes extending therethrough, wherein at least one of the radiant tubes is bent to define an "offset" that absorbs differential thermal growth between radiant tubes. Each tube having this offset permits elimination of pigtails normally required for flexible connection of the tube with a process fluid inlet manifold. Also, by providing for absorption of overall coil growth by deflection of the cross-over piping that connects the convection section tubing to the radiant tubes, the pulley/-counterweight system normally required to both absorb thermal growth of, and support, each radiant tube can be eliminated or greatly simplified in that, for example, a simpler, cheaper pulley/variable-load spring arrangement could be substituted for performing the solo function of supporting the radiant tube. A fired heater in accordance with the present invention could utilize either a single radiant section, as shown, by Wallace, or a plurality of radiant sections, as shown (for example) by U.S. Pat. No. 3,182,638 and U.S. Pat. No. 3,450,506.

By using such offset tubes instead of the above-described pigtails, the overall chances for coking to occur within the tubes is decreased. And even if coking does occur, it can normally be blown out of the tubes, as opposed to cutting out coked sections of pigtails. Furthermore, the use of offset tubes in accordance with the present invention offers the distinct advantages of less congestion around the furnace burners. Thus, burner maintenance and process changes are more easily accomodated.

In accordance with other, preferred features of the present invention, the overall thermal growth of the coil is accommodated by provision of a "floating" inlet manifold, that is, the inlet manifold for the coil is supported in such a manner as to be able to move in response to, and accordingly absorb at least a major portion of, the overall thermal growth of the coil. In addition to being rigidly connected to each radiant tube in the coil, the inlet manifold is, preferably, also rigidly attached to at least one cross-over pipe, i.e., the pipe that conducts process fluid from the furnace convection section to the radiant section thereof. Being, thus, suitably supported by both the radiant tubes and the cross-over pipe, the inlet manifold is generally free to move, by deflection of the cross-over pipe, in response to the overall thermal growth of its corresponding coil.

Due to optimum operational and design considerations, such as the minimization of pressure drop and coking, as well as, minimal spacing of tubes in a coil, the above-described offset configuration of the radiant tubes should take the form of first and second radiant tube sections, preferably substantially straight, transversely and longitudinally offset from each other by an interconnecting tube section. As a result, at the point of interconnection between the interconnecting tube section and each of the first and second tube sections, an interconnection angle is defined. It is these interconnection angles that permit each radiant tube to absorb the differential thermal growth; as the first and second tube sections grow, these angles change. There are preferably only two bends in any given tube, thus only two angles.

Based on structural and operational considerations, the interconnection angles for each tube should be at least about 10°; at smaller angles, the tube would lose much of its ability to bend. It is, of course, preferred that all radiant tubes in a given row be bent according to the present invention. To optimize efficiency of operation, the tubes should be placed as close to each other as possible, but in such a manner as to avoid touching during operation of the fired heater. Accordingly, the interconnection angles should be less than about 75°.

Larger angles could result in adjacent tubes touching during furnace operation. Measured transversely, the maximum length of the offset should be up to about 10% of the overall length of a respective tube, preferably up to about 5% thereof.

The interconnection angles for a given radiant tube could be the same or different. While this also applies for angles of adjacent tubes, it is preferred that all tubes in a row have substantially the same interconnection angles, both in their respective offsets and with respect to each other, to yield mutually parallel tubes. In any event, it is more preferred that all tubes in a row (coil) be offset in a common plane, most preferably the plane of the coil (commonly referred to as the "coil plane"). This reduces the chances of any of the tubes moving toward the row of burners generally arranged on either side of the coil and, thus, the chances of a tube or tubes being heated to temperatures above its metallurgical limit. This also tends to even out the thermal growth of the individual tubes.

Also in accordance with the present invention, each tube bent in the coil plane can be at least partially bowed in a direction out of the coil plane. Each tube can, thus, be bowed over a portion of its overall length or over the entire extent thereof. Despite the fact that a row of radiant tubes are bent in the coil plane as described above, during operation each tube will still tend to grow or distort in a direction out of the coil plane. If adjacent tubes distort along paths that cross, they could touch each other during operation, or one could block the other from an adjacent row of burners (known as "shielding effect"), both undesirable results. By bowing a tube in a preselected direction out of the coil plane, it can be assured that the tube will distort in that direction. By bowing all bent tubes in a row in the same direction out of the coil plane (i.e., at the same angle out of the coil plane), it can be reasonably assured that they will all distort in the same direction during furnace operation, thus, avoiding the "shielding effect", touching, or uneven heating of the tubes. It is preferred that the bent tubes in a row all be bowed in a direction perpendicular to the coil plane. The amount of bow could be as high as about 10% of the overall tube length. The minimum could be as low as about one inside tube diameter, e.g., for a 2 inch inside diameter tube, about 2 inches. When "swage" tubes, as described in detail below, are used, the minimum would be about one minimum inside diameter. As an alternative to bowing, the bent tubes could be otherwise "displaced" out of the coil plane, as by moving the outlets or inlets of all radiant tubes out of the coil plane (described in detail below).

In alternative embodiments in accordance with the present invention, instead of providing radiant tubes bent in a common (coil) plane, the tubes could be "skewed" out of the plane. This skewing could be accomplished either by at least partially bowing the tube out of the common plane, or by displacement of one of the tube inlet or outlet out of the coil plane or both bowing and displacing the tube. During operation of the furnace and thermal growth of the tubes, this skewing will force thermal growth in the direction of the skew. All tubes in a row are, preferably, skewed in the same direction out of the coil plane. In any one of these alternative embodiments, the maximum amount of skew is, preferably, up to about 10% of the overall length of a respective skewed tube. The minimum amount of skew is, preferably, equal to about one inside diameter of the respective tube.

The invention will be more clearly and readily understood from the following description and accompanying drawings of preferred embodiments which are illustrative of fired heaters and radiant tubes in accordance with the present invention and wherein:

FIG.'s 1 and 2 are schematic side views of a radiant tube in accordance with the present invention;

FIG. 3*a* is a plan view showing a row of the tubes illustrated in FIG.'s 1 and 2 according to one embodiment of the present invention;

FIG. 3*b* is a similar plan view to 3*a*, but showing a row of tubes according to another embodiment of the present invention;

Figure 1:
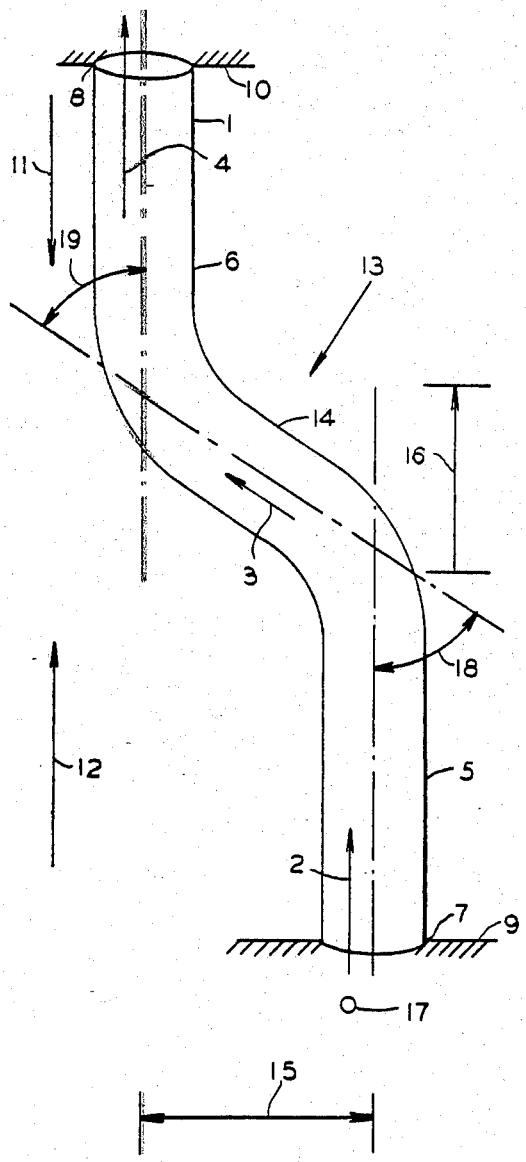

Referring now to the drawings, wherein like reference numerals are generally used throughout to refer to like elements, and particularly to FIG.'s 1 and 2, 1 is a single-pass, radiant conduit means for directing process fluid, preferably hydrocarbon process fluid, therewithin (as indicated, for example, by arrows 2, 3 and 4) through the radiant section of a fired heater, preferably a hydrocarbon (pyrolysis) cracking furnace, in a once-through manner. Although radiant conduit means 1 could have any cross-sectional configuration, a tubular conduit wherein the cross-sectional configuration is circular is preferred. Also, conduit means could have a constant cross-sectional flow area throughout its length or a swage configuration in which the cross-sectional flow area gradually increases from the inlet to the outlet, e.g., inlet inside diameter of 2.0 inches and outlet inside diameter of 2.5 inches. This radiant conduit means, as shown, has a first conduit section 5, preferably a lower inlet section through which hydrocarbon process fluid flows in use in a first direction 2, and a second conduit section 6, through which the fluid flows in use in a second direction 4. These sections are, preferably substantially straight. Directions 2 and 4 are, preferably, substantially the same; as shown both are upward. Most preferably these directions are substantially mutually parallel. As schematically illustrated at 7 and 8, inlet section 5 and outlet section 6 are each rigidly attached to elements 9 and 10. Element 9 is, preferably, an inlet manifold for distribution of hydrocarbon process fluid to a plurality of radiant conduit means 1 rigidly connected thereto. Element 10 could be an outlet manifold for heated hydrocarbon process fluid or a transfer line heat exchanger for cooling said fluid.

Figure 4:
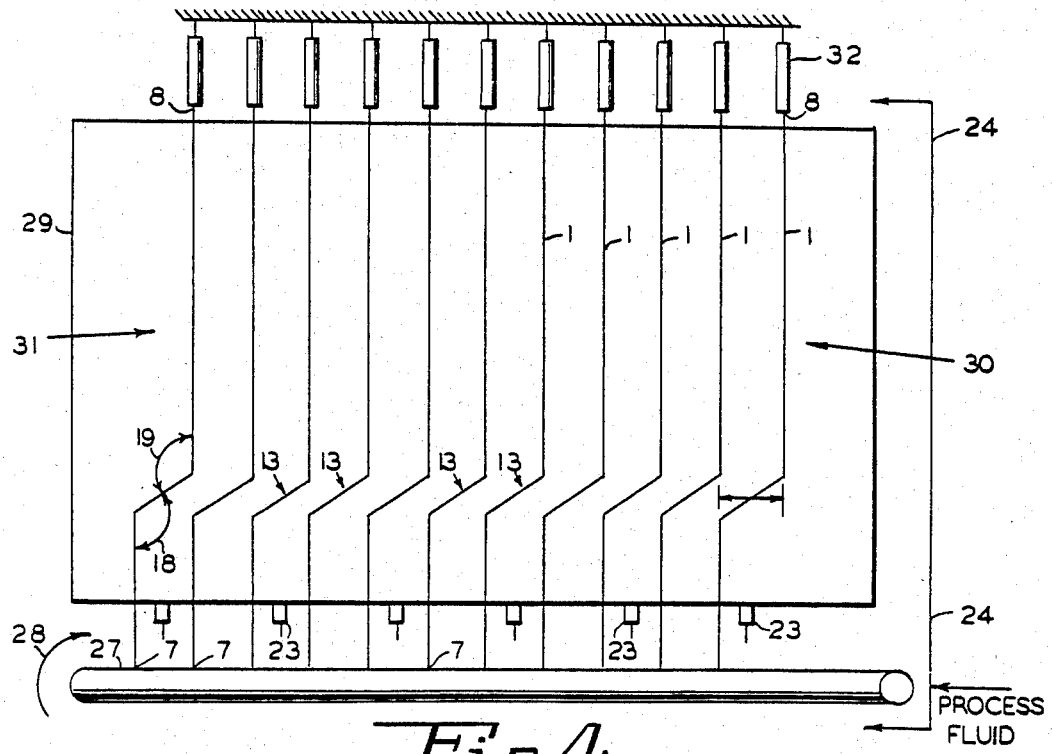
FIG. 4 is a schematic side view of a fired heater constructed in accordance with the present invention.

As shown, for example, in FIG. 4, in use plural radiant conduit means 1 are preferably arranged in row 31, rigidly connected to a common inlet manifold 27. As described in more detail below, inlet manifold is a "floating" inlet manifold to provide for absorption of the overall thermal growth of the corresponding coil (row of tubes). Thus, while the overall thermal growth of the coil is provided for, some provision must also be made for differential thermal growth of the tubes in a coil to prevent rupturing of welds and/or severe distortion of the coil.

Due to rigid connections 7 and 8, sections 5 and 6 can either move toward each other, or longitudinally distort (as from a straight to bent configuration), in response to differential thermal expansions experienced during furnace operation. This movement of sections 5 and 6 toward each other is indicated by arrows 11 and 12. To provide for absorption of this thermal growth without significant distortion of the conduit means, offset 13 is provided, preferably within the radiant section of the furnace.

Offset 13 comprises fluid flow conduit interconnecting means 14 which interconnects sections 5 and 6 in fluid flow communication and offsets these sections transversely 15 and longitudinally 16. As shown at 16, "longitudinal offset" requires that the ends of section 5 and 6 closest to each other be separated by some distance. This offset can have a transverse length 15 of up to about 10% of the respective overall tube length within the radiant section. For example, an offset of 15 to 20 inches for a tube of about 30 feet would be satisfactory.

By virtue of this longitudinal and transverse offset of radiant inlet section 5 from radiant outlet section 6, a particle (molecule) of hydrocarbon process fluid 17 flowing through radiant conduit means 1 as indicated by arrows 2, 3 and 4, will have to change its direction of flow, from inlet section 5 to fluid flow conduit interconnecting means 14 by an angle 18, and from fluid flow conduit interconnecting means 14 to outlet section 6 by an angle 19. These angles are measured before operation of the fired heater (expansion of radiant tubes) and can be defined by the intersections of longitudinal lines drawn axially through the various sections of the radiant conduit means 1, as shown.

Figure 2:
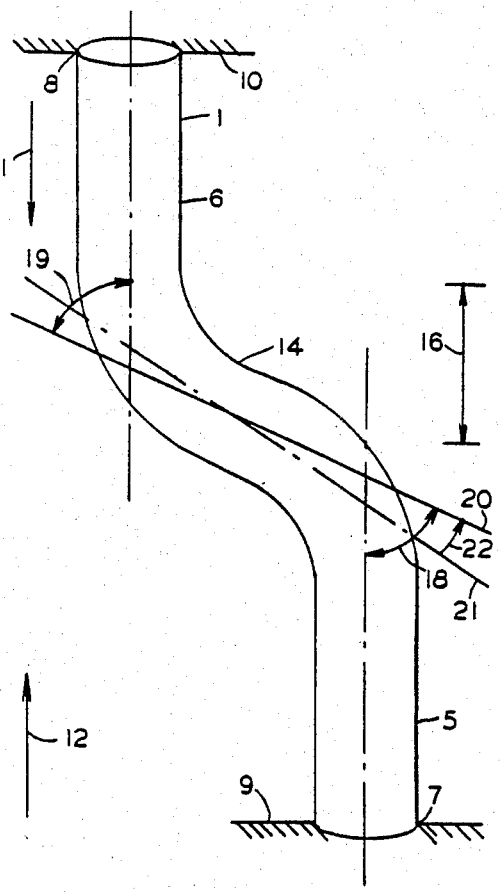

It is by virtue of these "interconnection" angles, resulting from the longitudinal and transverse offset of sections 5 and 6, that radiant conduit means 1 can self-absorb differential thermal growth which occurs during furnace operation. FIG. 1 illustrates a radiant conduit means 1 according to the present invention before the furnace is fired up and, thus, before the conduit means experiences thermal growth. FIG. 2 illustrates the radiant conduit means 1 of FIG. 1, but as it exists during furnace operation when differential thermal growth is experienced. As conduit means 1 experiences thermal expansion, conduit sections 5 and 6 will "grow" toward each other, as indicated by arrows 11 and 12. As conduit sections 5 and 6 grow toward each other, angles 18 and 19 change (by increasing) and, thus, absorb thermal growth of conduit means 1. To further illustrate this angle change, 20 (in FIG. 2) refers to the longitudinal centerline of fluid flow conduit interconnecting means 14 during furnace operation (when conduit means 1 is thermally expanded) and 21 refers to the same centerline, but before the furnace is operational (conduit means 1 is not expanded as shown in FIG. 1). It can be seen that due to the thermal growth of radiant conduit means 1 and the resulting growth of conduit sections 5 and 6 toward each other (11 and 12), the longitudinal centerline of fluid flow conduit interconnecting means 14 has, in effect, rotated counter-clockwise (arrow 22) from position 21 to position 20. As a result, angles 18 and 19 have changed in response to this thermal growth. Should the temperature within the radiant section of the furnace decrease during operation (or shutdown), radiant conduit means 1 will contract (shrink), thus decreasing angles 18 and 19. Thus, with fluctuations of temperature, angles 18 and 19 will vary.

Based on structural and operational considerations, angles 18 and 19 should be kept within limits. If these angles are too small before furnace operation, the radiant conduit means will be too straight and lose its ability to self-absorb thermal growth along these angles in a manner to avoid rupture of welds and tube distortions. The minimum angle should thus be about 10°. A minimum angle of about 20° is preferred. To optimize furnace efficiency, it is desirable, particularly in the case of hydrocarbon pyrolysis, to arrange pluralities of radiant conduit means 1 in rows within the radiant section (see FIG. 4) with the conduit means being arranged as close together as is feasible. If angles 18 and 19 are too large before furnace operation and the conduit means are arranged close to each other, during furnace operation when the conduit means expand, the interconnection angles will become so large, e.g., about 90°, that adjacent conduit means will touch. This can distort the conduit means and/or drastically alter their temperature profiles, having a negative impact on furnace efficiency. Accordingly, to permit close spacing of radiant conduit means 1 without the danger of adjacent ones touching during furnace operation, the maximum angles should be about 75°. The preferred maximum is about 60°.

Figure 3A:
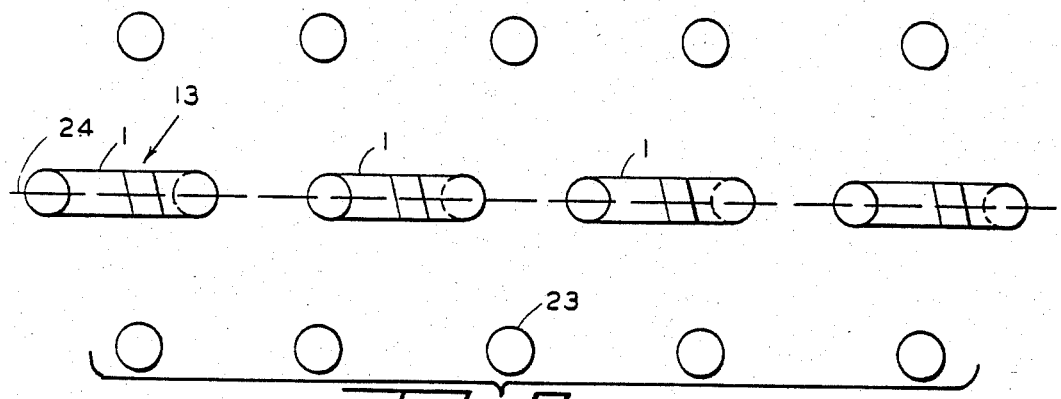
Figure 3B:
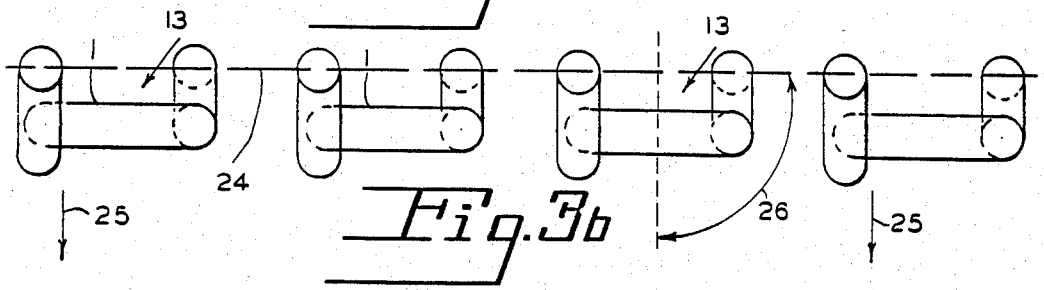

In heating a process fluid in general, and particularly when cracking hydrocarbon process fluid, it is desirable to arrange the once-through radiant conduit means 1, in the form of radiant tubes, in at least one row and in parallel to each other, as shown, for example, in FIGS. 3*a*, 3*b* and 4. Burners 23 are arranged in rows along both sides of each row of radiant tubes 1. Particularly as it relates to hydrocarbon cracking, the distance from a row of burner flames to the corresponding row of radiant tubes is critical and most carefully selected, and it should be kept as constant throughout operation of the furnace as is feasible. It is, accordingly, most desirable to prevent, or at least minimize, the extent of radiant tube distortion, during furnace operation, toward the burners. It is primarily for this reason that in any given coil (row) of tubes the offsets, preferably, lie substantially in a common plane, most preferably in the plane of the coil 24. This imparts to the individual tubes in any give row the predisposition to bend during furnace operation along the coil plane and, thus, in a direction parallel to the row(s) of burners.

Despite this predisposition of the radiant tubes in any coil to, thus, bend along the coil plane, the severe thermal stresses to which they are subjected will, most likely, still cause some tube distortion out of the coil plane toward the burners. If adjacent radiant tubes distort unevenly toward a row of burners, the heat distribution amongst the tubes will be uneven. An adverse effect on coking of the tubes can be experienced. Also, if the paths of distortion of adjacent tubes cross, it is possible for one radiant tube to shield the other from the burners ("shielding effect") or even for the tubes to touch. To prevent, or at least minimize, these undesirable results, the radiant tubes are at least partially bowed (FIG. 5) in a direction 33 away from the coil plane 24. To prevent touching or shielding of adjacent tubes, this direction should be the same for all radiant tubes in a given row, that is, it is preferred that all radiant tubes in a given row be at least partially bowed in the same direction away from the coil plane. The preferred bow direction is at an angle of 90° (26). By virtue of this bend, any distortion of the radiant tubes in a given row will tend to be in the same direction toward the burners, thus avoiding shielding or touching of adjacent tubes.

It can thus be seen that, in the event the radiant tubes 1 are both offset 13 within the coil plane and bowed out of the coil plane, the offsets will, in actuality, not really lie along a true plane. Accordingly, the coil plane would be defined in terms of that plane along which the tubes would lie if they hadn't been bowed (FIG. 3*a*).

Figure 7:
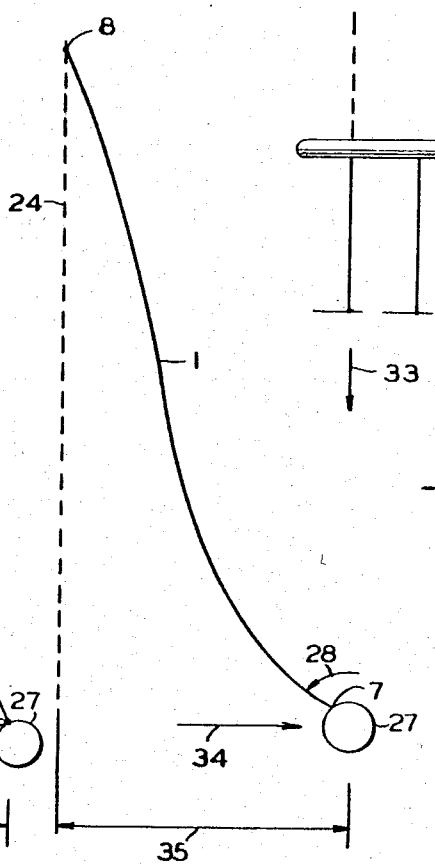
FIG. 7 is also a schematic side view of an alternative embodiment of a radiant tube in accordance with the present invention wherein the tube is skewed by both displacement and bowing out of the coil plane.
Figure 5:
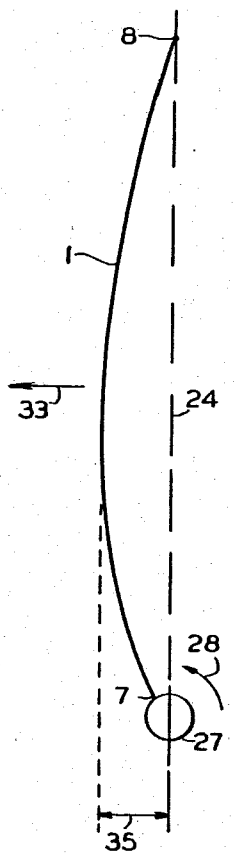
FIG. 5 is a schematic side view of an alternative embodiment in accordance with the present invention in which a radiant tube is skewed by bowing out of a coil plane.

The bowing of the tubes can be accomplished by simple means. In the event that the radiant tubes in any given row are all rigidly attached both at their inlet ends 7, to a common inlet manifold 27 (FIG. 4) and at their outlet ends 8, they can be bowed by simply rotating the inlet manifold, as indicated by arrow 28 (FIGS. 4, 5 and 7). Depending on such factors as the amount of rotation of the inlet manifold, the length and diameter of the tubes, the compositions of the tubes, etc., the resulting tubes will either be bowed along a portion of their respective lengths (FIG. 7) or throughout their respective lengths (FIG. 5).

A row (coil) of radiant conduit means 1 arranged within a radiant section of a fired heater is schematically shown in FIG. 4. Radiant section enclosure means 29, preferably of refractory material, defines at least one radiant section 30 of a fired heater. Extending within radiant section 30 is at least one row 31 of radiant conduit means 1, preferably in the form of vertical tubes, to define a corresponding coil plane 24. To impart heat to process fluid flowing through tubes 1, heating means 23, preferably burners, are provided, preferably in rows along both sides of each tube coil 31. The process fluid is fed to the radiant tubes from common inlet manifold 27 to which each tube is rigidly attached at 7. In the case of hydrocarbon cracking, this process fluid has been preheated in a convection section of the furnace. After being radiantly heated within enclosure 29, in the instance of hydrocarbon cracking, the cracked process fluid is fed to receiving means, preferably directly to transfer line exchangers 32 for quenching to stop further reaction of the process fluid (reaction mixture). It is also possible to collect the heated process fluid in a common outlet manifold and then direct it downstream for further processing. e.g., distillation, stripping, etc. In either event, the tube outlets are rigidly connected at 8, either to the transfer line exchanger or to the common outlet manifold. The burners are, preferably floor mounted adjacent the radiant tube inlets.

Figure 8:
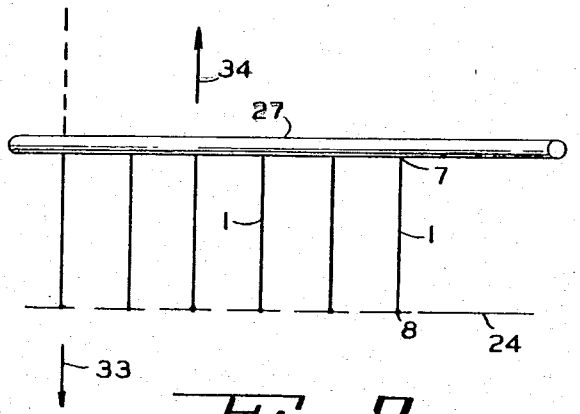
FIG. 8 is a schematic plan view of a row of tubes according to FIG. 5, 6 or 7 showing the relationship of the tubes to the coil plane.

As indicated above, radiant tubes in accordance with the present invention can be either offset or both offset within a common plane and bowed out of the common plane to cope with thermal stresses experienced during furnace operation. According to another embodiment in accordance with the present invention, instead of the offset, the radiant tubes can optionally be at least partially "longitudinally skewed" out of the coil plane 24 (FIG. 8), as illustrated in FIG.'S 5–8. "Longitudinally" means along their respective lengths. "Skew" means that the radiant tubes at least partially extend out of a vertical coil plane 24 drawn through the outlets 8 of the tubes in a given row.

As shown in FIG. 5, the radiant tubes 1 can be skewed by bowing them out of vertical coil plane 24, preferably all in the same direction 33 out of the vertical coil plane. This bowing can be accomplished, for example, by rotating the inlet manifold 27 as shown at 28.

Figure 6:
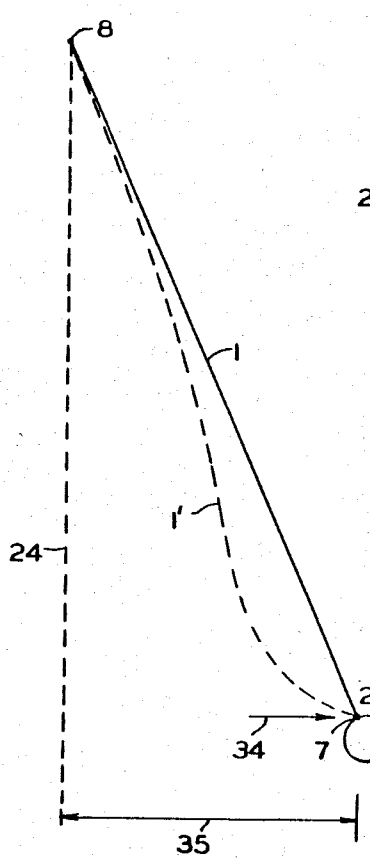
FIG. 6 is also a schematic side view of an alternative embodiment of a radiant tube in accordance with the present invention wherein the tube is skewed by displacement out of a coil plane.

As shown in FIG. 6, the radiant tubes in a given row can be skewed by horizontal displacement 34 of their inlets out of the vertical coil plane. The tubes will distort thermally as shown by dotted line 1′ during furnace operation.

As shown in FIG. 7, the radiant tubes 1 can, optionally, be both bowed and displaced. This is achieved by horizontal displacement of the inlets 7 and rotation of the inlet manifold.

By virtue of this longitudinal skewing, the tubes will be predisposed to distort thermally, that is, change their respective longitudinal configurations, along the direction 33 of the skew. The radiant tubes in any given row are, preferably, skewed in the same direction out of the vertical coil plane to avoid, or minimize, shielding or touching of adjacent tubes and uneven heat distribution. The amount of skew 35, as measured from the vertical coil plane to the furthest point along the tube away from the vertical coil plane, can be up to about 10% of the overall length of the tubes. The minimum would be about one-half of one inside tube diameter, the minimum inside diameter for a swage tube.

Figure 9:
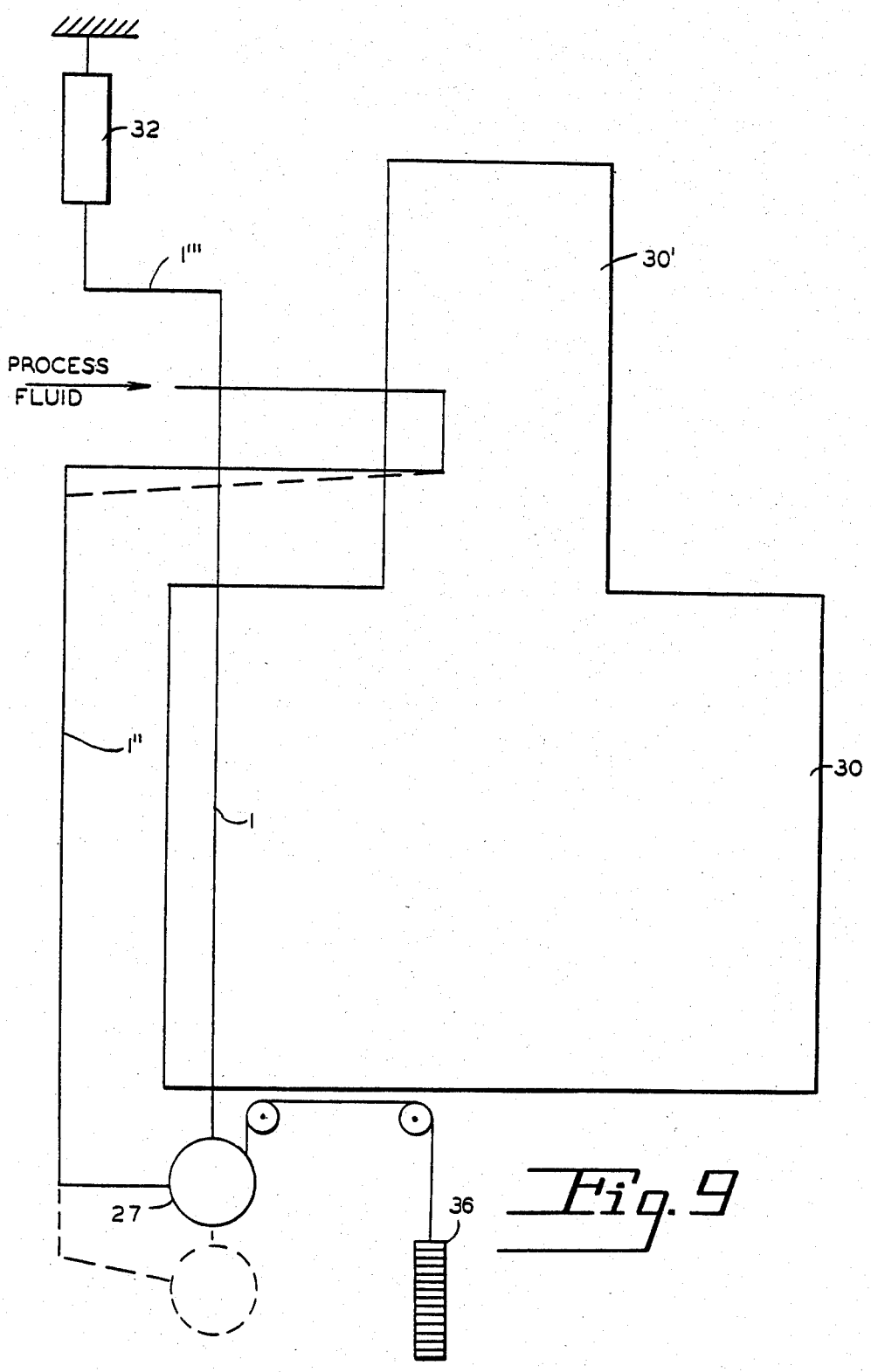
FIG. 9 is a schematic front view of a fired heater in accordance with the present invention showing additional preferred features thereof.

As shown schematically in FIG. 9, a "floating" inlet mainfold 27, one that can move in order to absorb a substantial amount (at least 40%) of the overall coil growth, can be provided by virtue of its (fluid flow) interconnections with radiant conduit means 1 and cross-over conduit means 1″ for conducting preheated process fluid from convection section 30′ to radiant section 30. In response to overall thermal growth of its corresponding coil, inlet manifold 27 can move downwardly as shown, for example, by the dashed lines in FIG. 9. Of course, the inlet manifold could be (and preferably is) connected to more than one cross-over pipe. To help support the weight of the inlet manifold, it may be desirable to add any known support means such as a known counterweight mechanism, schematically indicated as 36 in FIG. 9. Also, should it be necessary to provide for additional absorption of the overall thermal growth of a coil, horizontal leg 1‴ could be added to each radiant conduit means 1, preferably outside radiant section 30. It is preferred that the floating inlet manifold be commonly connected to each radiant tube in a given row.

The invention has been described with reference to the preferred embodiments thereof. However, as will occur to the artisan, variations and modifications thereof can be made without departing from the claimed invention.

What is claimed is:

1. A fired heater for heating process fluid comprising:

radiant section enclosure means for defining at least one radiant section of said heater, at least one row of plural, single-pass radiant conduit means extending longitudinally within each of said radiant sections, each of said radiant conduit means having a rigid inlet connection to a common inlet manifold and a rigid outlet connection to receiving means to which process fluid is fed in use such that differential thermal growth of said conduit means is constrained during use of said heater, and at least one row of burners arranged adjacent to said row of radiant conduit means to heat said radiant conduit means in use, wherein at least one of said inlet and outlet connections in said row all lie along a common, vertical coil plane, and wherein said radiant conduit means in said row are at least partially skewed in substantially parallel planes out of said vertical coil plane such that during operation of said fired heater said skewed conduit means each absorb differential thermal expansions and contractions between adjacent conduit means by changing longitudinal configuration in substantially the same direction with respect to said row of burners.

2. A fired heater according to claim 1, wherein said radiant conduit means are at least partially bowed out of said vertical coil plane.

3. A fired heater according to claim 1, wherein said conduit means are at least partially bowed out of said vertical coil plane and the other of said inlet and outlet connections is horizontally displaced from said vertical coil plane.

4. A fired heater for heating process fluid comprising:

radiant section enclosure means for defining at least one radiant section of said heater, at least one row of single-pass radiant conduit means through which said process fluid flows in use extending within said radiant section, said conduit means each having an inlet section connected to a common inlet manifold and an outlet section connected to receiving means to which heated process fluid is fed in use, and at least one row of burners arranged adjacent to said row of radiant conduit means to heat said process fluid as it flows through said radiant conduit means in use, wherein each of said radiant conduit means is bent in that it has at least a first conduit section through which said process fluid flows in use in a first flow direction and at least a second conduit section through which said process fluid flows in use in a second flow direction, said first and second conduit sections being transversely and longitudinally offset in fluid flow communication by interconnecting means, wherein said first and second conduit sections and said interconnecting means define a process fluid flow path that changes between said first conduit section and said interconnecting means and between said interconnecting means and said second conduit section, each change by an angle of about 10°-75°, and wherein said radiant conduit means are each bent in substantially parallel planes, whereby a predisposition is imparted to said conduit means to move during heater operation in substantially the same direction with respect to said row of burners.

5. A fired heater according to claim 4, wherein said first and second conduit sections are interconnected by said interconnecting means in a first plane, said conduit means are at least partially bowed in a bow direction away from said first plane, and said first and second flow directions are substantially the same.

6. A fired heater according to claim 5, wherein said bow direction is perpendicular to said first plane.

7. A fired heater according to claim 3, wherein said first conduit section is the inlet section of said radiant conduit means, said second conduit section is the outlet section of said radiant conduit means, and said angles are about 20°-60°.

8. A fired heater according to claim 7, wherein said radiant conduit means has an inside diameter of about two inches or less and an overall length of about fifty feet or less.

9. A fired heater according to claim 8, wherein said radiant conduit means is bowed an amount equal to about ten percent or less of the overall radiant conduit means length.

10. A fired heater according to claim 4 or 9, which is a steam cracking furnace.

11. A hydrocarbon cracking tube according to claim 10, where said tube is coil-free.

12. A fired heater according to claim 10, wherein said first and second conduit sections are substantially mutually parallel.

13. A fired heater according to claim 4, further comprising at least one convection section, wherein said inlet manifold is a floating inlet manifold.

14. A fired heater according to claim 13, wherein said floating inlet manifold is commonly connected by rigid connection to the inlet end of each radiant conduit means in a given row of radiant conduit means.

15. A fired heater according to claim 14, wherein each floating inlet manifold is also rigidly connected in fluid flow communication with an outlet end of at least one cross-over conduit means.

16. A fired heater according to claim 15, wherein said first and second conduit sections are substantially straight and each of said radiant conduit means is a tube.

17. A fired heater according to claim 16, wherein said offsets are within a radiant section of said heater.

18. A fired heater according to claim 17, wherein the bent conduit means in each row are offset in a common plane.

19. A fired heater according to claim 18, wherein said common plane is a coil plane.

20. A fired heater according to claim 19, wherein each bent conduit means is at least partially bowed in a bow direction away from said common plane.

21. A fired heater according to claim 20, wherein all bent conduit means in a row are at least partially bowed at about the same angle away from said common plane.

22. A fired heater according to claim 21, wherein said same angle is about 90° away from said common plane.

23. A fired heater according to claim 18, wherein each bent conduit means is at least partially bowed in a bow direction away from said common plane.

24. A fired heater according to claim 23, wherein all bent conduit means in a row are at least partially bowed at about the same angle away from said common plane to define substantially mutually parallel radiant conduit means.

25. A fired heater according to claim 16, wherein said angle is about 20°-60°.

26. A fired heater according to claim 25, wherein said transverse offset has a length of up to about ten percent of the respective total radiant conduit means length.

27. A fired heater according to claim 26, wherein each radiant conduit means has an overall length of about 15 to 50 feet and an inside diameter of about 1 to 2 inches, and wherein said bow is up to about ten percent of the overall radiant conduit means length.

28. A fired heater according to claim 27, wherein each radiant conduit means has an overall length of about 20 to 40 feet.

29. A fired heater for pyrolyzing normally gaseous or normally liquid aromatic and/or aliphatic hydrocarbon feedstocks to obtain olefins and other products comprising:

refractory enclosure means defining at least one radiant pyrolysis section, at least one convection section, at least one row of bent, single-pass radiant tubes extending within said refractory enclosure means to define a corresponding coil plane, and at least one row of burners arranged adjacent to said row of radiant tubes within each radiant pyrolysis section to heat said radiant tubes, wherein each bent tube has a lower, substantially straight inlet tube section rigidly attached to an inlet manifold and an upper, substantially straight outlet tube section rigidly attached to receiving means for receiving pyrolyzed hydrocarbon from the tube, such that during pyrolysis differential thermal growth between the individual tubes in said row is constrained by said rigid connections, wherein said inlet and outlet tube sections are transversely and longitudinally offset in fluid flow communications by an interconnecting tube section to absorb differential thermal growth between the tubes in said row during pyrolysis, wherein said inlet and outlet tube sections and said interconecting tube section define a hydrocarbon flow path that changes between said inlet tube section and said interconnecting tube section and between said interconnecting tube section and said outlet tube section, each change by an angle of about 10°–75°, and wherein said first and second tube sections and said interconnecting tube section all lie in said corresponding coil plane to define at least one row of substantially mutually parallel tubes, whereby a predisposition is imparted to said tubes to move during heater operation in substantially the same direction with respect to said row of burners.

30. A fired heater according to claim 29, wherein each bent tube is additionally bowed in a direction away from its corresponding coil plane and said inlet manifold is a floating manifold.

31. A fired heater according to claim 30, wherein each floating inlet manifold is commonly connected in fluid flow communication to the inlet tube sections of all radiant tubes in a given row.

32. A fired heater according to claim 31, wherein each floating inlet manifold is also rigidly connected in fluid flow communication with an outlet end of at least one cross-over conduit means.

33. A fired heater according to claim 1, wherein the other of said inlet and outlet connections is horizontally displaced from said vertical coil plane.

34. A fired heater according to claim 1, 33 or 3 wherein said conduit means comprise radiant tubes.

35. A fired heater according to claim 34, wherein said inlet manifold is a floating inlet manifold.

36. A fired heater according to claim 35, wherein the maximum amount of skew for each tube is equal to up to about ten percent of the overall length of the tube.

37. A fired heater according to claim 36, wherein the minimum amount of skew for each tube is equal to about one inside tube diameter.

38. A fired heater according to claim 37, wherein each tube has an inside diameter of up to about two inches and an overall length of up to about fifty feet.

39. A fired heater according to claim 38, wherein said tube length is up to about forty feet.

40. A fired heater according to claim 29 or 4, wherein said burners are floor mounted burners.

41. A hydrocarbon cracking tube according to claim 29 or 4, wherein said tube is coil-free.

* * * * *